US006929130B2

(12) United States Patent
Sampaio

(10) Patent No.: US 6,929,130 B2
(45) Date of Patent: Aug. 16, 2005

(54) EXPANDABLE DISH DRAINER

(75) Inventor: Andre Sampaio, Blauvelt, NY (US)

(73) Assignee: Kaminstein Imports, Inc., Blauvelt, NY (US)

( * ) Notice: Subject to any disclaimer, the term of this patent is extended or adjusted under 35 U.S.C. 154(b) by 0 days.

(21) Appl. No.: 10/353,443

(22) Filed: Jan. 29, 2003

(65) Prior Publication Data

US 2004/0144738 A1 Jul. 29, 2004

(51) Int. Cl.[7] ..... A47G 19/08
(52) U.S. Cl. ..... 211/41.6; 211/41.3; 211/126.1
(58) Field of Search ..... 211/41.2, 41.3, 211/41.5, 41.6, 74, 85.18, 76, 126.1, 133.6; D32/55–57; 220/487, 488, 572; 206/446, 303, 389, 391, 557, 822

(56) References Cited

U.S. PATENT DOCUMENTS

| | | | | | |
|---|---|---|---|---|---|
| 222,542 | A | | 12/1879 | Stearns | |
| 591,377 | A | * | 10/1897 | Bunce | 220/572 |
| 946,977 | A | * | 1/1910 | Muller | 211/41.6 |
| 1,452,418 | A | * | 4/1923 | Cunneen | 211/41.3 |
| 1,622,909 | A | * | 3/1927 | Hatcher | 220/487 |
| 2,039,927 | A | * | 5/1936 | Poglein | 211/13.1 |
| 2,378,628 | A | | 6/1945 | Gray | |
| 2,516,088 | A | * | 7/1950 | Einhorn | 211/41.5 |
| 2,958,424 | A | * | 11/1960 | Bigatti | 211/41.5 |
| 3,442,395 | A | | 5/1969 | Taylor | |
| 3,800,957 | A | * | 4/1974 | Krause | 211/41.3 |
| 3,889,837 | A | * | 6/1975 | Wilson | 220/7 |
| 4,169,638 | A | * | 10/1979 | Cirasuolo et al. | 312/229 |
| 4,221,299 | A | | 9/1980 | Taylor | |
| D259,537 | S | | 6/1981 | Taylor | |
| 4,328,899 | A | | 5/1982 | Krusche | |
| D271,339 | S | * | 11/1983 | Lee | D32/55 |
| 4,756,582 | A | * | 7/1988 | Heien | 312/229 |
| 4,842,350 | A | * | 6/1989 | Collings | 312/228 |
| 4,884,714 | A | * | 12/1989 | Bechtel | 220/630 |
| 5,279,071 | A | * | 1/1994 | McDougall | 47/40.5 |
| 5,318,190 | A | | 6/1994 | Mason | |
| D362,942 | S | | 10/1995 | Licari | |
| 5,833,075 | A | * | 11/1998 | Czaplinski et al. | 211/41.2 |
| D413,700 | S | | 9/1999 | Wang | |
| 6,170,676 | B1 | | 1/2001 | Patadia et al. | |
| 6,179,134 | B1 | | 1/2001 | Pine et al. | |
| D448,132 | S | | 9/2001 | Wolfenden | |
| 6,325,222 | B1 | * | 12/2001 | Avery et al. | 211/65 |
| 6,516,956 | B2 | * | 2/2003 | Martorella et al. | 211/41.6 |
| 2001/0040141 | A1 | | 11/2001 | Martorella et al. | |

FOREIGN PATENT DOCUMENTS

| | | | | | |
|---|---|---|---|---|---|
| GB | 2042147 | A | * | 2/1980 | 211/41.6 |

* cited by examiner

*Primary Examiner*—Jennifer E. Novosad
(74) *Attorney, Agent, or Firm*—Stephen E. Feldman, PC

(57) ABSTRACT

An expandable dish rack with a drainage channel and port. The rack is expandable to hold larger dishes and increase its capacity.

14 Claims, 3 Drawing Sheets

EXPANDABLE DISH DRAINER

BACKGROUND OF THE INVENTION

1. Field of the Invention

The present invention relates generally to the field of dish draining racks and apparatus for maintaining dishes while draining and drying.

More specifically, the present invention relates to dish draining racks with expandable areas for maintaining wares to be drained, and to dish draining racks with controllable flow of water which has drained from the wares held by the rack.

2. Background of the Related Art

It is well known to use racks of various configurations to maintain dishes, pots, pans, utensils and other dishware and cookware while drying. These racks generally may maintain the wares relatively securely to prevent breakage and promote more rapid drying.

Draining racks generally consist of one or more surfaces adapted to accept the wares to be drained. These surfaces are of fixed area and accommodate a fixed number of wares, depending on size and geometry of the wares to be maintained by the drainer.

Several configurations of dish drainage racks are common. One configuration employs a slatted design wherein the surface of the dish drainer adapted for maintaining the wares consists of several slats which may securely receive plates, for example. Examples of this configuration are disclosed in U.S. Pat. Nos. 4,328,899 and 222,542. Other configurations forgo slats in favor of ribbed surfaces for maintaining wares. In this type of configuration, the surface for maintaining wares includes a series of ribs extending from the surface of the dish draining rack. These ribs act in a similar fashion to the slats of the previously discussed configuration, and are disclosed for example in U.S. Pat. No. D448,132 S. Each of the foregoing designs provides a fixed area for receiving and maintaining wares. It is impossible to expand or contract the ware-drying area to accommodate greater or lesser capacities depending on the individual needs of users on a case-by-case basis.

In addition to securely maintaining wares while drying, draining racks also provide egress for water draining from wares. Currently known draining racks accomplish this in several manners. One common configuration for dish drainers provides direct draining of water through a plurality of orifices formed in the surface which maintains the wares. This often leads to the undesirable condition wherein the surface on which the drainer is placed, e.g., a kitchen counter top, becomes wet and untidy. In the slatted configuration, water is permitted to drain from the wares, through the slats, to the surface on which the dish drainer is place, e.g., a kitchen counter top. Again, this configuration promotes wet, untidy counter top and other surfaces.

Certain draining racks known in the art contain structures for collecting water which has drained from wares. These structures generally consist of a relatively large surface placed at the bottom of or underneath the draining rack. Some such structures permit collected water to flow over one or more edges of the structure into a sink or other desirable destination. Water collected in these structures, however, often is unable to adequately drain, requiring the user of the draining rack to manually evacuate the collected liquid.

It has also been a goal of designers of dish draining racks to provide draining racks which store easily when not in use.

To this end, several foldable dish draining rack designs have been employed. One such foldable design is a "scissor" type design wherein the dish draining rack is comprised substantially of two members connected to one another at a pivot point, allowing the two members to rotate relative to one another in a scissor-like fashion. Another foldable design is disclosed in U.S. Pat. No. 6,170,676 B1. This design includes an essentially planar surface for maintaining wares comprised of multiple hinged sections which fold for compact storage. Due to the design aspects directed towards storability in the foregoing implementations, the designs do not provide a great deal of protection of the wares being dried.

It is desirable, therefore, to create a dish draining rack which includes one or more expandable surfaces for receiving and maintaining wares to be dried. It is further desirable to create a dish draining rack which is storable and adequately protects the wares it holds. Finally, it is desirable to create a dish draining rack which provides for controllable removal of water which has drained from the wares held in the draining rack.

SUMMARY OF THE INVENTION

The present invention discloses a dish draining rack which contains one or more expandable surfaces for receiving and maintaining wares to be dried. This surface is formed so as to provide adequate protection of the wares it holds. The present invention further discloses a dish draining rack with mechanisms to permit the controllable removal of water which has drained from the wares held in the draining rack.

A preferred embodiment of the present invention includes a dish draining rack having a base member including a top side and a bottom side, the top side defining an arcuate surface for maintaining wares, an expansion member operatively coupled to the base member, the expansion member being moveable relative to the base member from a closed position to an open position, whereby the expansion member effectively increases the surface area of the surface for maintaining wares when it is in its open position. This embodiment further includes a drainage channel having proximal and distal ends formed in the base member, the proximal end including a drainage port which allows water to drain from the drainage channel into, for example, a kitchen sink. The drainage channel is inclined downward from the distal end to the proximal end. The embodiment also includes a plurality of support members extending substantially perpendicularly from the bottom side of the base member.

Movement of the expansion member in the foregoing embodiment may be limited to slidable motion relative to the base member, but may also employ other movements such as rotational motion about a hinge connected between the base member and the expansion member.

The surface for maintaining the wares in foregoing embodiments of the present invention may include a plurality of spaced-apart, generally linear, raised members extending substantially perpendicularly from it, the members defining interstitial spaces between neighboring members. The expansion member may have a plurality of teeth adapted for placement in the interstitial spaces formed by the raised members, and may have generally planar tabs extending from its periphery which may be accepted into slots formed in the base member, thereby securely coupling the expansion to the base member.

The embodiments discussed above may also include a removable sealing member which prohibits flow of liquid through the drainage port when placed in a closed position and which permits flow of liquid through the drainage port when in an open position.

Certain embodiments may further include a storage mode support member which acts to support the dish drainer when the dish drainer is in storage mode; that is, when it is not in use and is being stored. When being stored, the dish drainer may be substantially vertical and generally perpendicular to the surface upon which it rests. The storage mode support member may be a generally planar surface formed on one end of the base member and may generally coincide with the proximal end of the drainage channel. The drainage port may be formed within the storage mode support member.

Further embodiments of the present invention may further include a utensil receptacle formed of a floor member and a plurality of side members projecting from the floor member. The base member of the dish draining racks in such embodiments may include a utensil receptacle receiving area formed in the base member for securely receiving the utensil receptacle. This utensil receptacle receiving area may be in the form of a recess formed in the top side of the base member.

The support members of the foregoing embodiments may be in the form of feet or legs, and may terminate in non-skid or skid-resistant surfaces, made from rubber or soft plastic, for example, to minimize or help eliminate sliding motion of the dish draining rack relative to the surface on which it is placed. Alternatively, the support members may operatively accept non-skid or skid-resistant coverings, made from rubber or soft plastic, for example, to minimize or help eliminate sliding motion of the dish draining rack relative to the surface on which it is placed.

These and other aspects of the subject invention will become more readily apparent to those having ordinary skill in the art from the following detailed description of the invention taken in conjunction with the drawings described herein.

BRIEF DESCRIPTION OF THE DRAWINGS

So that those having ordinary skill in the art to which the subject invention pertains will more readily understand how to make and use the subject invention, preferred embodiments thereof will be described in detail herein with reference to the drawings.

DETAILED DESCRIPTION OF THE PREFERRED EMBODIMENTS

Figure 1:
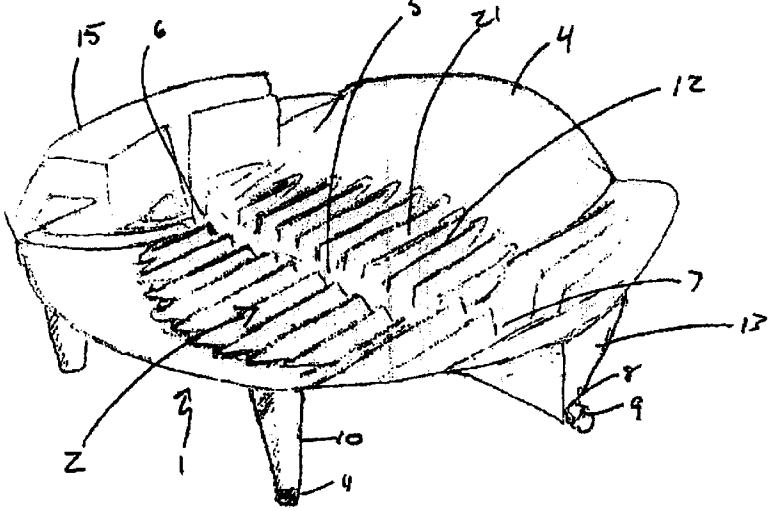
FIG. 1 is a perspective view of a preferred embodiment of the present invention.

Referring now in detail to the drawings wherein like reference numerals identify similar structural features of the several embodiments of the subject invention, there is illustrated in FIG. 1 a perspective view of a preferred embodiment of the present invention. Base member 1 includes arcuate surface for maintaining wares 2 on its top side. Expansion member 4 is operatively coupled to surface 2 and is being maintained in its closed position. Drainage channel 5 slopes from its distal end 6 to its proximal end 7, terminating in drainage port 8. Sealing member 9 covers drainage port 8, thereby preventing the flow of water through drainage port 8 from drainage channel 5. Raised members 12 extend substantially perpendicularly from the arcuate surface for maintaining wares 2, defining interstitial spaces 21 between neighboring raised members 12. Support member 10, in the general form of a support leg, has on its distal end a skid-resistant covering 11. Utensil receptacle area 15 is shown in the form of a recess formed in the top side of the base member 1. Storage mode support member 13 is formed as a generally planar surface on one end of base member 1 and generally coincides with proximal end 7 of drainage channel 5. Drainage port 8 is formed within storage mode support member 13.

Figure 2:
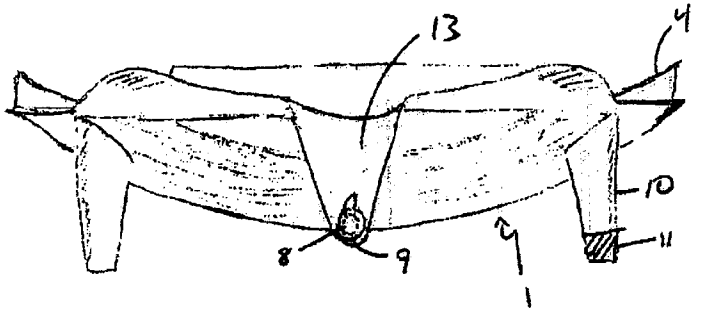
FIG. 2 is an end elevation view of a preferred embodiment of the present invention.

FIG. 2 shows an end elevation view of a preferred embodiment of the present invention. Base member 1 includes support member 10 which terminates in a skid-resistant covering 11. Drainage port 8 is shown with sealing member 9 in a covering position. Expansion member 4 is operatively coupled to base member 1 in the closed position. Storage mode support member 13 is formed as a generally planar surface on one end of base member 1. Drainage port 8 is formed within storage mode support member 13.

Figure 3:
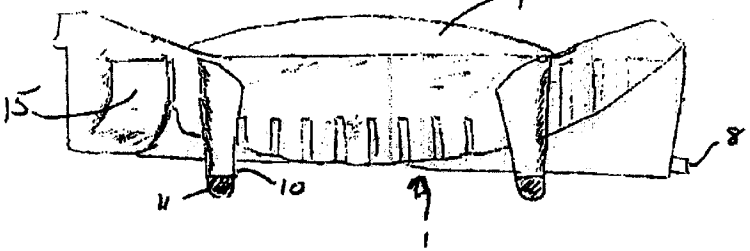
FIG. 3 is a side elevation view of a preferred embodiment of the present invention.

FIG. 3 shows a side elevation view of a preferred embodiment of the present invention. Support members 10, each having a skid-resistant covering 11, extend downwardly from base member 1. Utensil receptacle area 15 extends downwardly from and is recessed in the top portion of base member 1. Expansion member 4 is coupled to base member 1 in the closed position.

Figure 4:
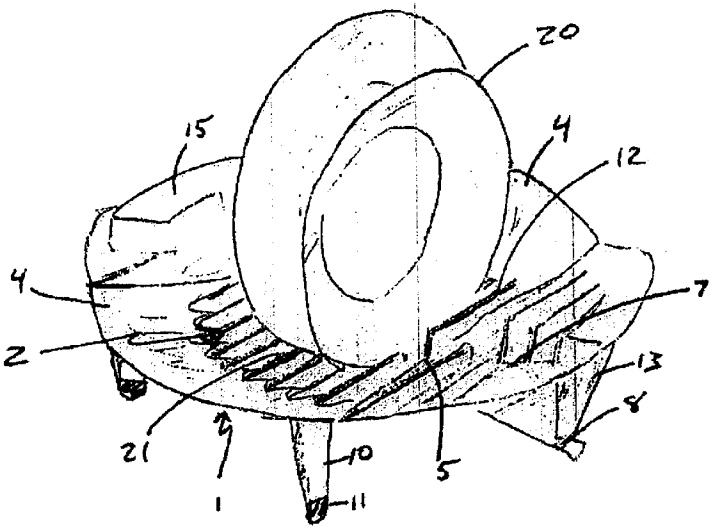
FIG. 4 is a perspective view of a preferred embodiment of the present invention holding two wares.

FIG. 4 shows a perspective view of a preferred embodiment of the present invention holding two wares, 20. Wares 20 fit in interstitial spaces 21 and are maintained in an upright position by raised members 12 to facilitate draining. Water which has drained from wares 20 travels under the influence of gravity down drainage channel 5 to proximal end 7 and out through drainage port 8. Support members 10 which have skid-resistant coverings 11 extend from the underside of base member 1 and maintain the dish drainer of the present invention securely on the surface upon which it rests. Expansion members 4 are in the closed position because the wares 20 are not sufficiently large to require additional surface area on the arcuate surface for maintaining wares 2. Utensil receptacle area 15 extends downwardly, recessed in the top portion of base member 1. Storage mode support member 13 is formed as a generally planar surface on one end of base member 1 and generally coincides with proximal end 7 of drainage channel 5. Drainage port 8 is formed within storage mode support member 13.

Figure 5:
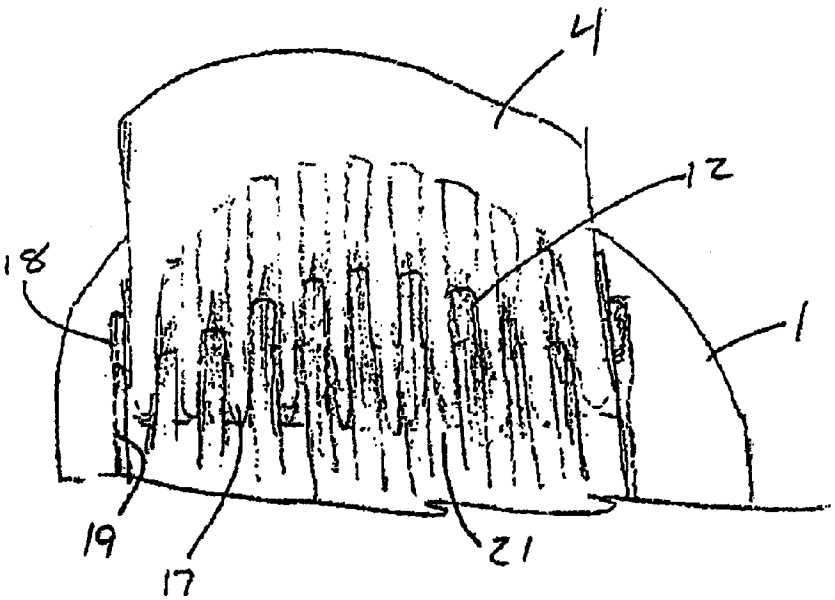
FIG. 5 is a detailed view of a portion of a preferred embodiment of the present invention.

FIG. 5 shows a detailed view of a portion of a preferred embodiment of the present invention. Expansion member 4 includes a plurality of teeth 17 which fit in interstitial space 21. Raised members 12 prevent side-to-side movement of expansion member 12 relative to base member 1. Expansion member 4 is maintained in its open position. Generally planar tab 18 extends into groove 19 formed in base member 1, substantially preventing perpendicular movement of expansion member 4 relative to base member 1. Expansion member 4 is free to move slidably from an open position to a closed position relative to base member 1, and is prevented from over extending by generally planar tab 18 and groove 19. When expansion member 4 reaches full extension, generally planar tab 18 abuts the end of groove 19, thus preventing further extension.

Figure 6:
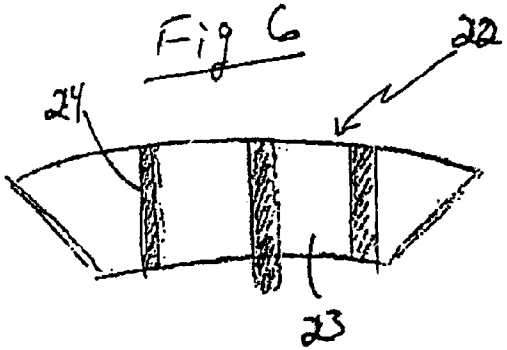
FIG. 6 is a plan view of the utensil receptacle of a preferred embodiment of the present invention.
Figure 7:
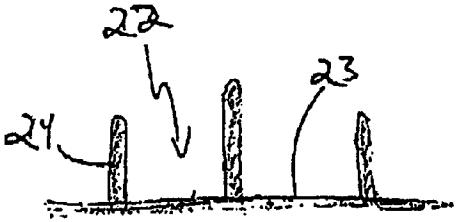
FIG. 7 is an elevation view of the utensil receptacle of a preferred embodiment of the present invention.

FIGS. 6 and 7 respectively show a plan view and elevation view of a utensil receptacle 22 of a preferred embodiment of the present invention. Base member 23 is shaped to generally conform to the shape of the utensil receptacle receiving area formed in the base member of an expandable dish drainer of the present invention (not shown). Three side walls, 24, extend perpendicularly from the base member 23. When utensil receptacle 22 is placed in the utensil receptacle receiving area of an expandable dish drainer of the present invention, side walls 24 act in combination with the utensil receptacle receiving area to form a structure for securely maintaining utensils to be drained.

While particular embodiments of the present invention have been shown and described, it will be apparent to those skilled in the pertinent art that changes and modifications may be made without departing from the invention in its broader aspects.

What is claimed is:

1. A dish draining rack comprising:

a base member including a top side and a bottom side, said top side defining an arcuate, surface for maintaining kitchenware;

an expansion member operatively coupled to said base member, said expansion member being moveable relative to said base member from a standard position to an extended position, said expansion member effectively increasing the surface area of said surface for maintaining kitchenware;

a drainage channel having proximal and distal ends formed in said base member, said proximal end including a drainage port, said drainage channel being inclined downward from said distal end to said proximal end; and a plurality of support members extending substantially perpendicularly from said bottom side of said base member, whereby said support members have a skid-resistant covering.

2. A dish draining rack as claimed in claim 1, wherein said expansion member is slidably movable relative to said base member.

3. A dish draining rack comprising:

a base member including a top side and a bottom side, said top side defining an arcuate surface for maintaining wares;

an expansion member operatively coupled to said base member, said expansion member being moveable relative to said base member from a standard position to an extended position, said expansion member effectively increasing the surface area of said surface for maintaining wares;

a drainage channel having proximal and distal ends formed in said base member, said proximal end including a drainage port, said drainage channel being inclined downward from said distal end to said proximal end; and a plurality of support members extending substantially perpendicularly from said bottom side of said base member, wherein said expansion member is slidably movable relative to said base member, and said surface for maintaining wares includes a plurality of spaced-apart, generally linear, raised members extending substantially perpendicularly from said surface for maintaining wares, said members defining interstitial spaces between neighboring ones of said members.

4. A dish draining rack as claimed in claim 3, wherein said drainage port includes a removable sealing member which prohibits a flow of liquid through said drainage port when the port is open.

5. A dish draining rack as claimed in claim 3, further comprising a storage mode support member on said proximal end of said drainage channel, wherein said drainage port forms part of said storage mode support member.

6. A dish draining rack as claimed in claim 3, wherein said expansion member includes a plurality of teeth formed therein, said teeth adapted for placement in said interstitial spaces.

7. A dish draining rack as claimed in claim 6, wherein said support members terminate in a bottom end, said bottom end including a skid-resistant covering for inhibiting sliding motion between said dish draining rack and the surface upon which it is placed.

8. A dish draining rack as claimed in claim 7, wherein said skid-resistant covering is formed of soft plastic.

9. A dish draining rack as claimed in claim 7, wherein skid-resistant covering is formed of rubber.

10. A dish draining rack as claimed in claim 3, further comprising:

a utensil receptacle having a floor member and a plurality of side members projecting from said floor member; and a utensil receptacle receiving area formed in said base member of said dish draining rack for securely receiving said utensil receptacle.

11. A dish draining rack as claimed in claim 10, wherein the drainage channel further comprises a drainage port sealing member which prohibits a flow of liquid through said drainage port when the port is closed and which permits a flow of liquid through said drainage port when the port is open.

12. A dish draining rack as claimed in claim 10, wherein said utensil receptacle receiving area is comprised of a recess formed in said top side of said base member.

13. A dish draining rack as claimed in claim 3, wherein:

said expansion member has a generally planar tab extending from the periphery of said expansion member; and said base member has a groove defined therein for operatively accepting said tabs of said expansion member when said expansion member is operatively coupled to said base member.

14. A dish draining rack comprising:

a base member including a top side and a bottom side, said top side defining an arcuate surface for maintaining wares, said surface for maintaining wares including a plurality of spaced apart, generally linear, raised members extending substantially perpendicularly from said surface for maintaining wares, said members defining interstitial spaces between neighboring ones of said members;

an expansion member operatively coupled to said base member, said expansion member being slidably moveable relative to said base member from a standard position to an extended position, said expansion member effectively increasing the surface area of said surface for maintaining wares when said expansion member is in its open position;

a drainage channel having proximal and distal ends formed in said base member, said proximal end including a drainage port, said drainage channel being inclined downward from said distal end to said proximal end, said drainage port having a removable sealing member which prohibits a flow of liquid through said drainage port when the port is closed and which permits a flow of liquid through said drainage port when the port is open;

a plurality of support members extending substantially perpendicularly from said bottom side of said base member, said support members having skid-resistant coverings for inhibiting sliding motion between said dish draining rack and the surface upon which it is placed;

a utensil receptacle having a floor member and a plurality of side members projecting from said floor member; and a utensil receptacle receiving area formed in said base member of said dish draining rack for securely receiving said utensil receptacle.

* * * * *